US007398564B2

(12) United States Patent
Andersen

(10) Patent No.: US 7,398,564 B2
(45) **Date of Patent: *Jul. 15, 2008**

(54) CLOSURE APPARATUS AND METHOD OF INSTALLING SAME

(76) Inventor: Robert Andersen, 2019 Fir St., Glenview, IL (US) 60025

( * ) Notice: Subject to any disclaimer, the term of this patent is extended or adjusted under 35 U.S.C. 154(b) by 352 days.

This patent is subject to a terminal disclaimer.

(21) Appl. No.: 10/484,667

(22) PCT Filed: Jul. 25, 2002

(86) PCT No.: PCT/US02/23580

§ 371 (c)(1),
(2), (4) Date: Jul. 6, 2004

(87) PCT Pub. No.: WO03/011096

PCT Pub. Date: Feb. 13, 2003

(65) Prior Publication Data

US 2004/0231036 A1 Nov. 25, 2004

Related U.S. Application Data

(63) Continuation-in-part of application No. 09/916,816, filed on Jul. 27, 2001, now Pat. No. 6,438,764.

(51) Int. Cl.
*A47K 13/10* (2006.01)

(52) U.S. Cl. ..... 4/246.3; 4/246.1; 292/114; 292/127

(58) Field of Classification Search ..... 4/236, 4/240, 241, 246.1, 246.2, 246.3, 246.4, 246.5, 4/248, 250, 411, 414; 292/106, 108, 114, 292/123, 126–128
See application file for complete search history.

(56) References Cited

U.S. PATENT DOCUMENTS

| | | | | | |
|---|---|---|---|---|---|
| 767,567 | A | * | 8/1904 | Keil | 292/127 |
| 979,005 | A | | 12/1910 | Hoffman | |
| 997,449 | A | * | 7/1911 | Henn et al. | 4/236 |
| 1,134,755 | A | * | 4/1915 | Marcuse | 4/246.1 X |
| 1,301,188 | A | * | 4/1919 | Stark | 4/240 X |
| 2,670,981 | A | * | 3/1954 | Wenham | 292/114 |
| 3,602,536 | A | * | 8/1971 | Gamble | 292/127 |
| 3,781,924 | A | * | 1/1974 | Davis, Jr. | 4/246.2 |
| 4,491,989 | A | | 1/1985 | McGrail | |
| 4,551,866 | A | | 11/1985 | Hibbs | |
| 4,951,323 | A | | 8/1990 | Shalom | |

(Continued)

*Primary Examiner*—Robert M Fetsuga
(74) *Attorney, Agent, or Firm*—Michael Best & Friedrich LLP

(57) ABSTRACT

A closure apparatus and a method of installing the same are provided. The closure apparatus is adapted to mount to a toilet having a cover (5), a bowl ledge (4), and a flush mechanism (3, 30). The closure apparatus includes a mounting bolt (15) having an opening therethrough and a rod (8) disposed within the opening. The apparatus also includes a spring (9) that is adapted to be deformed by the rod to thereby bias the rod and a lever (11) movable with respect to the mounting bolt. A latch release mechanism (25, 27) coupled to the lever is also included. Upon flushing the toilet when the cover is open, and when the closure apparatus is mounted on the bowl ledge, the latch release mechanism causes the latch point of the lever to move with respect to the mounting bolt and allows the spring to move the rod, which pushes the cover, to thereby close the cover.

16 Claims, 13 Drawing Sheets

U.S. PATENT DOCUMENTS

| | | | |
|---|---|---|---|
| 4,975,988 | A | 12/1990 | Won |
| 5,060,318 | A | 10/1991 | Jaskiewicz |
| 5,222,260 | A | 6/1993 | Piper |
| 5,267,356 | A | 12/1993 | Gideon et al. |
| 5,289,593 | A | 3/1994 | Lawrence |
| 5,307,524 | A | 5/1994 | Veal |
| 5,410,766 | A | 5/1995 | Schumacher |
| 5,430,897 | A | 7/1995 | Lavender |
| 5,488,744 | A | 2/1996 | Paananen |
| 5,504,947 | A | 4/1996 | Robello et al. |
| 5,570,478 | A | 11/1996 | Armstrong |
| 5,754,985 | A | 5/1998 | Dias |
| 5,781,938 | A | 7/1998 | Anderson |
| 5,867,843 | A | 2/1999 | Robello et al. |
| 6,112,336 | A | 9/2000 | Markle et al. |
| 6,185,754 | B1 | 2/2001 | Dysle |
| 6,230,336 | B1 | 5/2001 | Knoll et al. |
| 6,438,764 | B1 | 8/2002 | Andersen |

* cited by examiner

CLOSURE APPARATUS AND METHOD OF INSTALLING SAME

This application is a 371 of PCT/US02/23580, filed Jul. 25, 2002, which is a continuation-in-part of U.S. application Ser. No. 09/916,816, filed Jul. 27, 2001, now U.S. Pat. No. 6,438,764.

TECHNICAL FIELD

The present invention relates generally to toilets, and, more specifically, to devices for closing a toilet cover.

BACKGROUND ART

There are many devices in the prior art which automatically, or semi-automatically, lower a toilet seat, a toilet lid, and/or a toilet seat and lid assembly. As users often neglect to fully close a toilet lid after use, a device for automatically closing a lid upon conventional flushing of the toilet offers a numbers of advantages. For example, when not in use, a fully closed toilet is safer in that it prevents children and pets from falling into the toilet bowl. In addition, a closed toilet is more sanitary in that it prevents pets from drinking from the bowl and averts cases of toilet users leaving the seat and lid assembly in an open position, thereby causing an inattentive subsequent user to sit on the actual toilet bowl instead of the toilet seat. In addition, it also helps to eliminate the situation where a male user utilizes the facility without raising the seat prior to urinating, by requiring that the male bend over and raise at least the lid, and preferably both the lid and seat, prior to urinating. Moreover, a fully closed toilet is overall more aesthetically pleasing.

However, all such known devices are believed to be relatively more obtrusive than the present invention in that they substantially detract from the usually smooth, simple appearance of the toilet or surrounding area, they make toilet cleaning more difficult, or they interfere with a conventional toilet's function, such as use of the flush handle. Most of the devices are also relatively complex and sometimes difficult to install, therefore often resulting in a rather costly device.

The devices of the prior art may be classified into several categories according to the actuation means each uses to initiate the closing of a lid and/or seat. More specifically, the actuation means used include: 1) foot pedals; 2) simple release of a user's hand, for those requiring the lid and/or seat to be held open while using the toilet; 3) sensors of various types; 4) timers of various types; 5) the toilet's existing flush handle; 6) water from either the supply line or the toilet's existing tank; 7) electric switches, which may primarily initiate flushing but also result in lid and/or seat closing; 8) the toilet's existing float or a special additional float or float/weight or float sensor; and, 9) the toilet's existing flush arm.

Unfortunately, all of these actuation means have disadvantages, for example, with respect to how they communicate with the lid and seat of the toilet. More specifically, several devices, such as those employing foot pedals, require the use of levers and/or rods and/or cylinders and/or air tubes positioned along the side(s) of the toilet bowl and all are believed to be highly obtrusive. For example, the devices set forth in U.S. Pat. Nos. 6,112,336, 5,289,593 and 5,267,356 disclose use of a visible sheathed cable end attached to an obtrusive mechanism mounted either atop the toilet's bowl ledge or to the side of said ledge. In addition, U.S. Pat. No. 5,781,938 discloses a float-actuated line which moves an obtrusive seat counter-balancing arm which is visible over the side of said ledge. U.S. Pat. No. 5,307,524 discloses an electric line over the side of the ledge to an obtrusive, expensive mechanism requiring a microprocessor atop the toilet's bowl ledge. U.S. Pat. Nos. 5,754,985 and 5,222,260 disclose obtrusive apparatus mounted atop the front of the toilet's tank.

Similarly, those employing the hand-release approach are also obtrusive in that they require the user to hold the lid and/or seat open while using the toilet. In addition, those employing timers are frequently visually obtrusive because the timers are generally incorporated into sizable devices mounted atop the toilet bowl ledge. Also, the timers may initiate closing action at a time inconvenient to a particular user.

Devices that use portions of a toilet's tank to assist with automatically closing a seat and lid assembly also have some disadvantages. For example, devices employing the toilet's existing flush handle are often visually obtrusive because the chains, cables, rods or levers are attached to or interact with the flush handle and their attachment to the flush handle interferes with use of the handle to flush the toilet. In addition, devices using the toilet's existing or added float(s), floating weights or a float switch are believed to be more visually obtrusive than the present invention in that they all employ a communication means with the seat or lid which may extend over the side of the toilet bowl's ledge or be mounted to the front of the toilet's tank. Those employing special added floats also reduce the effective water capacity of the tank which is especially disadvantageous when used with smaller, lower flush volume toilets.

Although sometimes not as visually obtrusive, several other devices are difficult to install, complex in design and therefore often expensive. For example, devices employing sensors of various types and electric switches to close the lid and/or seat are believes to be considerably complex and costly. In addition, devices employing either water from the toilet's supply line or tank require additional plumbing work and therefore are relatively difficult to install. Also, these devices increase risk of water leakage.

Of all disclosed devices referred to above, only U.S. Pat. No. 6,230,336 disclosed use of a direct mechanical connection to the toilet's flush arm as the actuating means. However, this direct mechanical connection is relied upon only to, via a line or cord, activate an electrical switch in an obtrusive electro-mechanical device atop the toilet bowl's ledge that appears to be complex and costly. The reason only this one of the many prior art devices uses such a connection to the flush arm as the actuation means is believed to be that most flush arms are designed with little more strength than that required to raise the flush valve and they will not tolerate a significant additional load without breaking.

Of all the known devices to open and close a toilet seat or lid, only the following utilize the standard lid/seat assembly mounting openings provided on toilet bowl ledges as a less obtrusive method of communicating between the automatic closing actuation means and the lid and seat: U.S. Pat. Nos. 6,230,336 and 6,185,754 disclose use of the mounting opening as a water conduit to an obtrusive mechanism mounted atop the toilet bowl's ledge; U.S. Pat. No. 5,867,843 discloses use of the mounting opening for an air tube to an obtrusive mechanism mounted atop the toilet bowl's ledge; U.S. Pat. Nos. 5,410,766 and 4,951,323 disclose use of the mounting opening as a pathway for a flexible cable to raise, rather than automatically lower, a seat or lid; while U.S. Pat. No. 4,975,988 discloses use of the mounting opening as a pathway for a flexible cable connected to a foot pedal to lower as well as raise the seat. None of the prior art uses the mounting opening or bowl ledge in the manner provided by the present invention.

DISCLOSURE OF INVENTION

A closure apparatus and a method of installing the same are provided.

More specifically, in one embodiment, the closure apparatus is adapted to mount to a toilet having a cover, a bowl ledge and a flush mechanism. The closure apparatus includes a mounting bolt having an opening extending therethrough and a rod disposed within the opening of the bolt. The apparatus also includes a spring that is adapted to be deformed by the rod to thereby bias the rod and a lever movable with respect to the mounting bolt. A latch release mechanism coupled to the lever is also included. Upon flushing of the toilet when the cover is open, and when the closure apparatus is mounted on the bowl ledge, the flush mechanism causes the latch point of the lever to move with respect to the mounting bolt. This allows the spring to move the rod which pushes the cover, to thereby close the cover.

The closure apparatus may further include an adjustment mechanism that engages the rod and the latch point of the lever. The adjustment mechanism may be adjustable with respect to the lever. The adjustment mechanism may include a stop adjuster or washer.

In another embodiment, a toilet is provided that includes a toilet bowl, a bowl ledge disposed on the toilet bowl and a tank disposed on a rear portion of the bowl ledge that includes a flush mechanism. The toilet further includes a cover that is disposed on the front end of the bowl ledge and a closure apparatus adapted to mount to the bowl ledge. The closure apparatus includes a mounting bolt having an opening extending therethrough and a spring-biased rod disposed within the opening of the bolt. The apparatus also includes a spring that is adapted to be deformed by the rod and lever movable with respect to the mounting bolt. A latch release mechanism coupled to the lever is also included. Upon flushing the toilet when the cover is open, and when the closure apparatus is mounted on the bowl ledge, the flush mechanism causes the latch point of the lever to move with respect to the mounting bolt. This allows the spring to move the rod which pushes the cover, to thereby close the cover.

In another embodiment, a toilet cover assembly adapted to mount to a toilet is provided. The toilet cover assembly includes a cover, a hinge mount adapted to mount to a bowl ledge of the toilet and a closure apparatus adapted to mount the hinge mount to the bowl ledge of the toilet. The closure apparatus includes a mounting bolt having an opening extending therethrough, a rod disposed within the opening of the mounting bolt and a spring adapted to be deformed by the rod to thereby bias the rod. The closure apparatus further includes a lever that has a latch point and is movable with respect to the mounting bolt and a latch release mechanism coupled to the lever. Upon flushing the toilet when the cover is open, and when the closure apparatus is mounted on the bowl ledge, the flush mechanism causes the latch point of the lever to move with respect to the mounting bolt. This allows the spring to move the rod which pushes the cover, to thereby close the cover.

A method of installing a closure apparatus adapted to mount to a toilet is also provided. The method includes the steps of securing a mounting bolt having a longitudinal opening therethrough to the bowl ledge of the toilet, inserting a spring-biased rod into the longitudinal opening of the mounting bolt, providing a spring and attaching a lever movable with respect to the mounting bolt. The method also includes the steps of connecting a first end of an actuating member to the lever and linking a second end of the actuating member to a flush mechanism.

MODES FOR CARRYING OUT THE INVENTION

Figure 1:
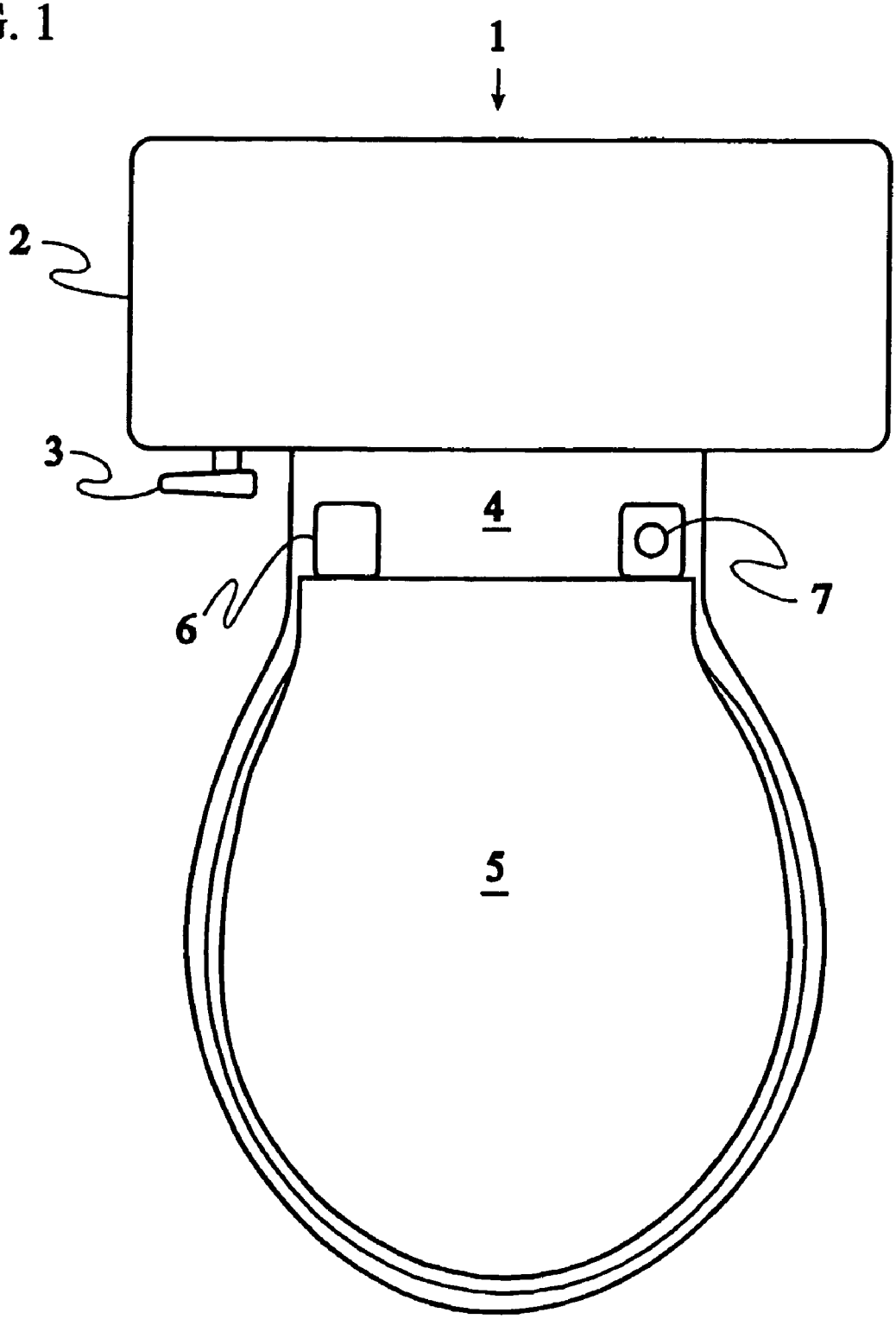
FIG. 1 is a top plan view of a conventional toilet, showing a portion of a first embodiment of a seat and lid assembly closure apparatus.

Referring now to FIGS. 1-5, a first embodiment of a seat and lid assembly closure apparatus is shown in combination with a conventional toilet 1. As shown, the conventional toilet includes a tank 2, having a flush handle 3 attached thereto, mounted on a bowl ledge 4. A cover, such as a seat, a lid 5 or a seat and lid assembly, is attached to a hinge mount 6 disposed on the bowl ledge 4. As shown, for example, in FIG. 3, the cover or lid 5 pivots at pivot point 12. In addition, the ledge 4 has a mounting opening 13 for mounting a hinge mount 6 of a toilet seat and lid 5.

As shown in FIG. 1, when viewing the toilet and closure apparatus from a top view, only an enlarged head 7 of a rod 8 of the apparatus is visible.

Figure 2:
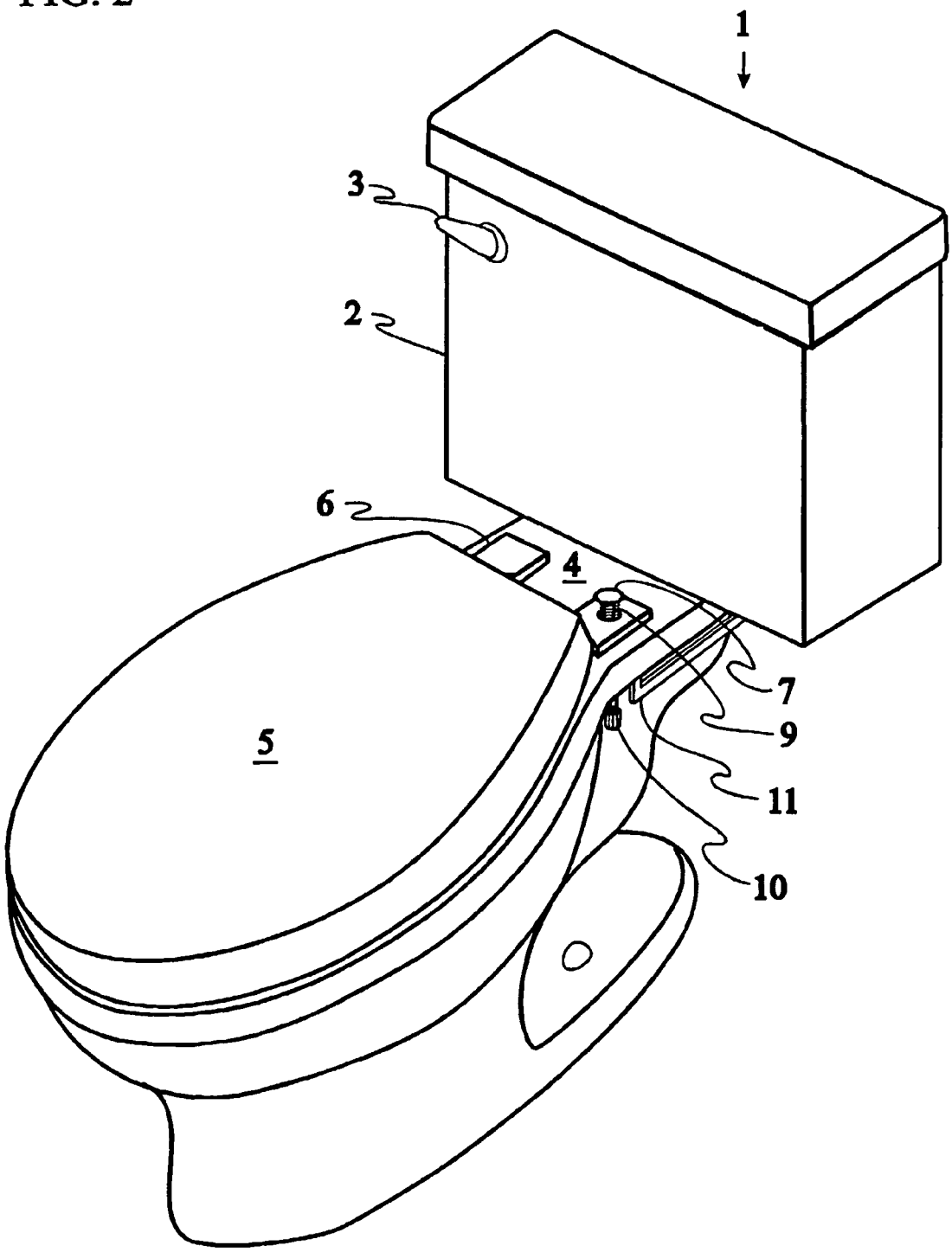
FIG. 2 is a perspective view of the toilet, wherein several portions of the first embodiment of the closure apparatus are shown.

As shown in FIG. 2, when viewing the toilet and closure apparatus from a side perspective view, only the head 7 of the rod 8 and the spring 9 are visible above ledge 4 and only a portion of an adjustment mechanism, such as a stop adjuster 10, and a lever 11 are partially visible below ledge 4.

Figure 3:
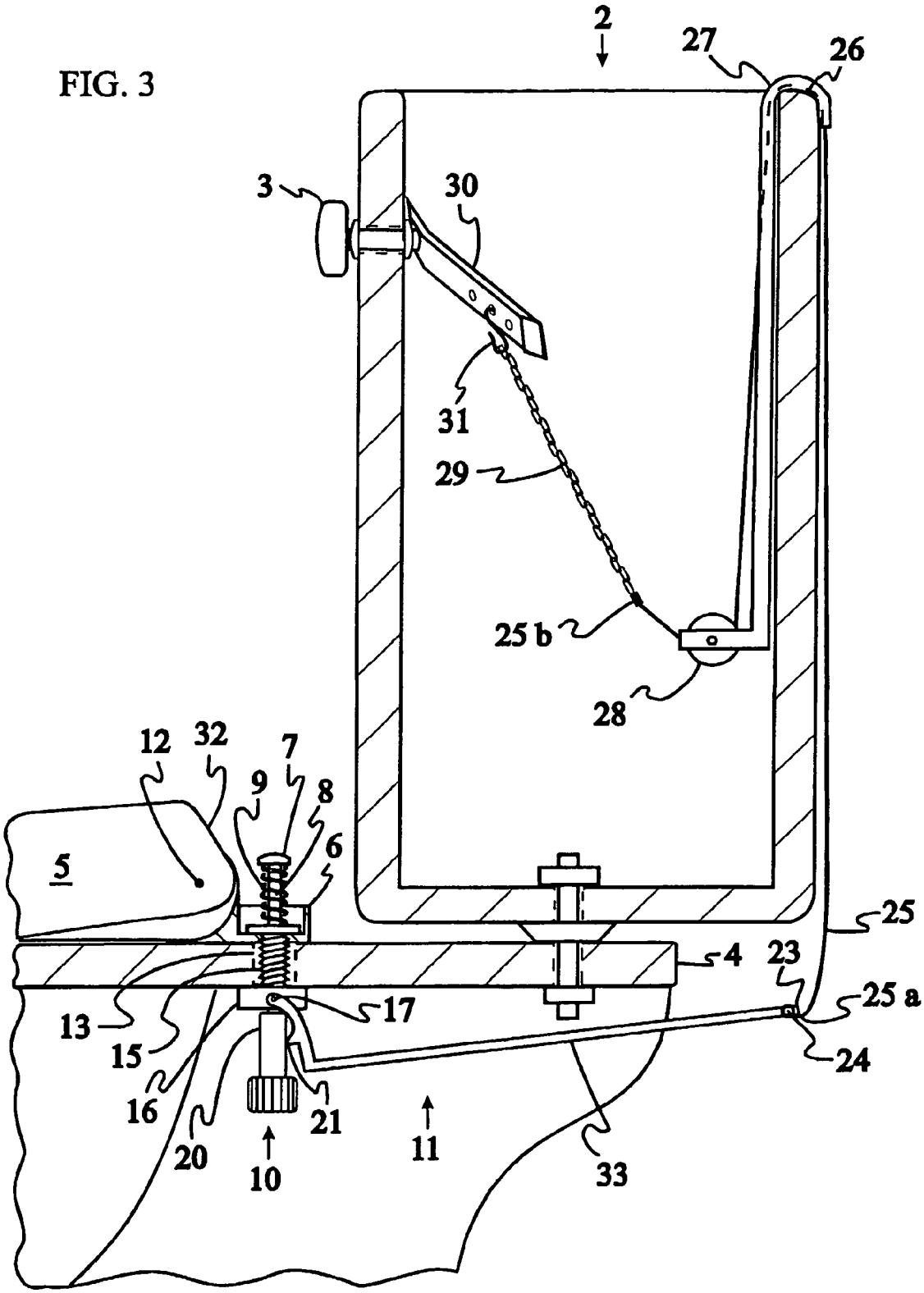
FIG. 3 is a side elevational view of the first embodiment of the closure apparatus, wherein a tank and a bowl ledge of the toilet are shown in section and a lid is in a closed position.
Figure 4:
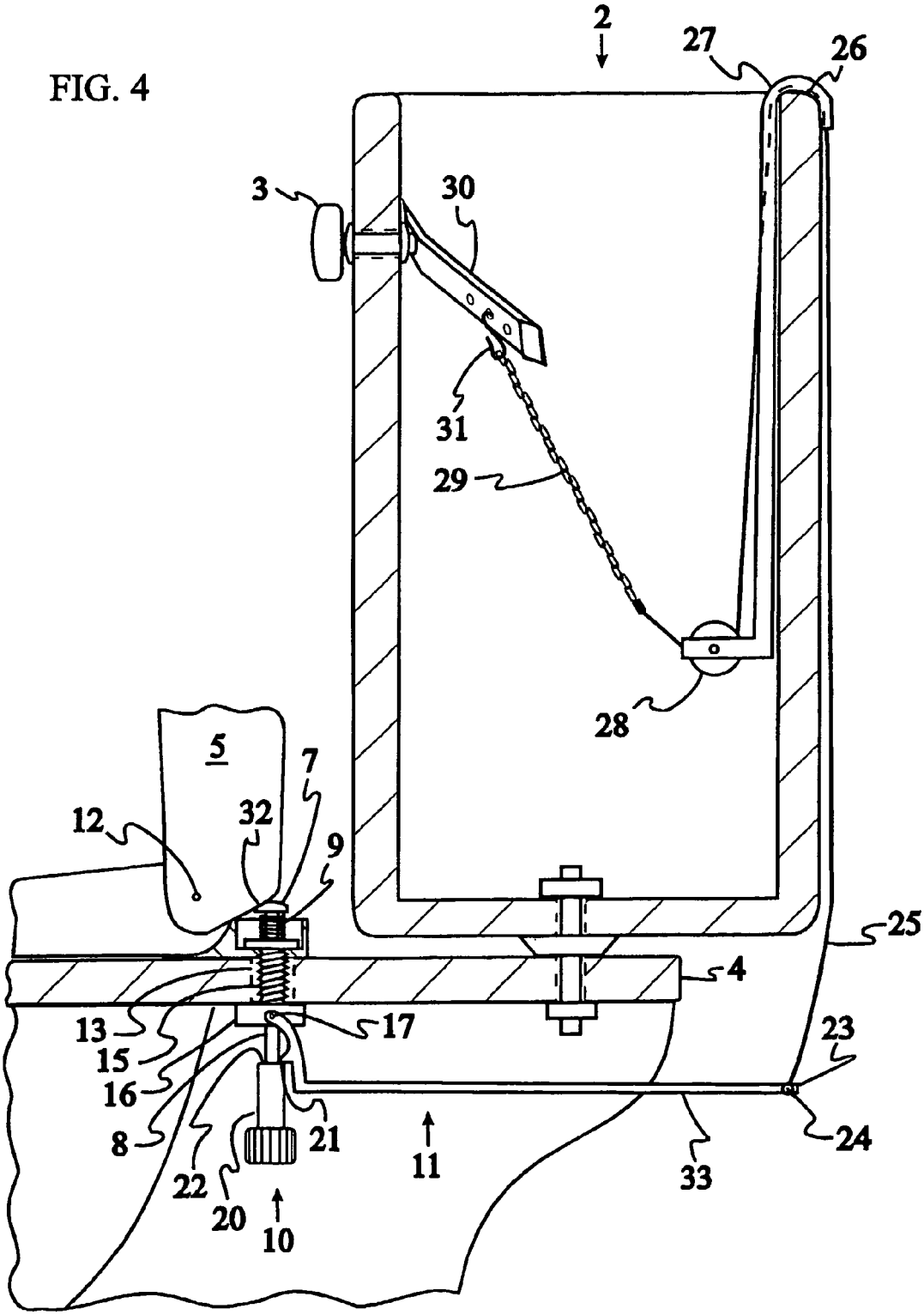
FIG. 4 is a side elevational view of the first embodiment of the closure apparatus, wherein the tank and the bowl ledge are shown in section and the lid is in an open position.
Figure 5:
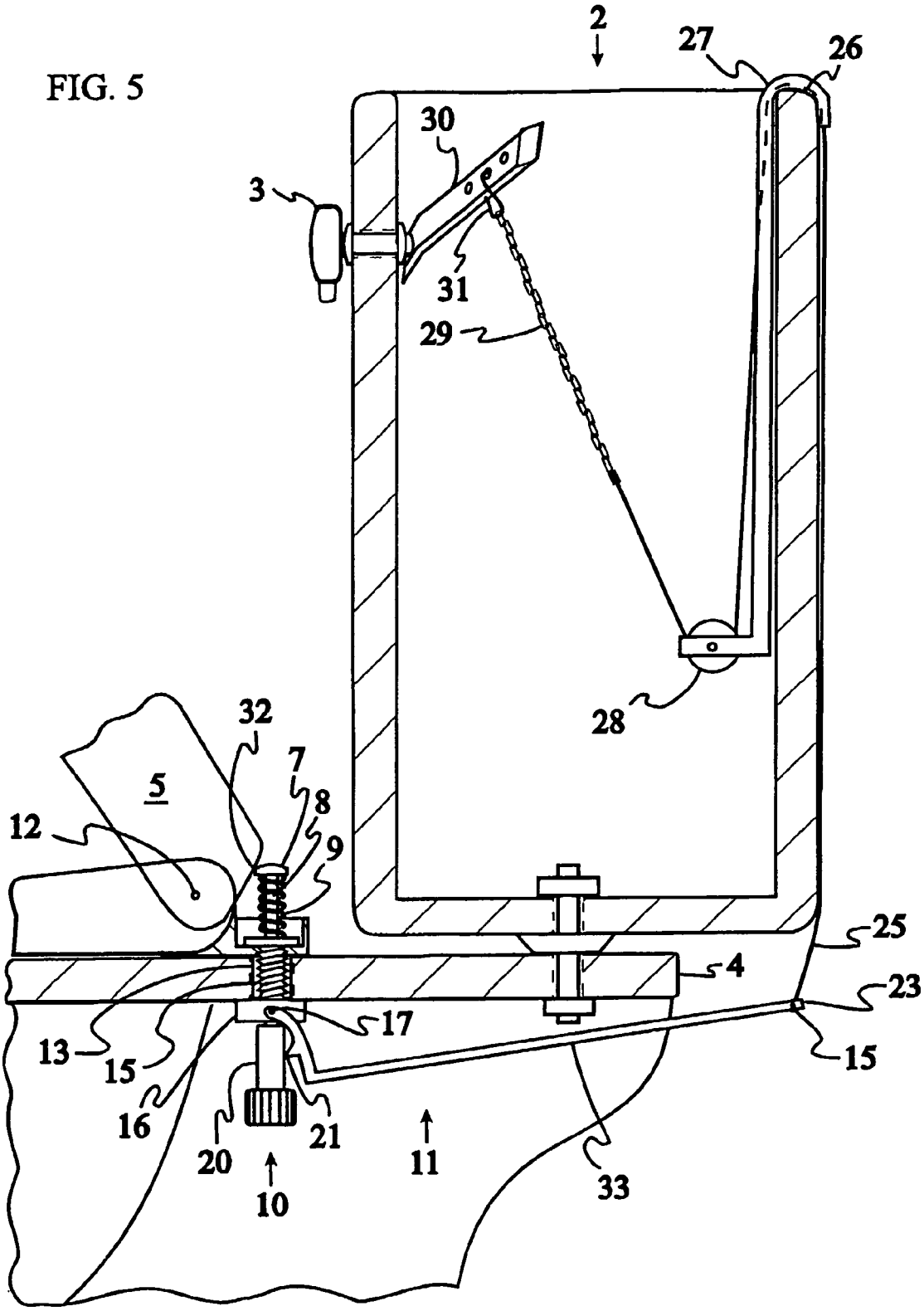
FIG. 5 is a side elevational view of the first embodiment of the closure apparatus, wherein the tank and bowl ledge are shown in section and a flush handle of the toilet has been actuated.
Figure 9:
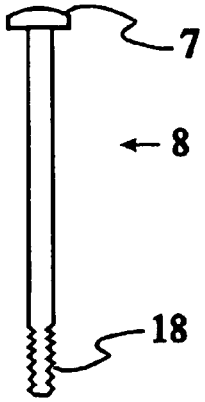
FIG. 9 is a side elevational view of the rod used in the first, second and third embodiments of the closure apparatus.

Referring now to FIGS. 3-5, the closure apparatus includes a rod 8 having a first end disposed above the ledge 4 and a second end disposed below the ledge 4. As shown in FIG. 9, the rod 8 includes a head 7 disposed at its first end and a series of male threads 18 at its second end. A spring, such as a compression spring 9, is disposed around the rod at its first end. The rod 8 may be constructed of plastic or non-corrosive metal, and other like materials.

The closure apparatus also includes a mounting bolt 15 having an opening, such as a longitudinal guide opening 14, for receiving a portion of the rod 8. The longitudinal guide opening 14, as shown in FIG. 6B, which is of only slightly larger inside diameter than the outside diameter of rod 8, serves as a guide to maintain the rod 8 in a vertical position as it moves up and down. More specifically, the rod 8 first extends through the compression spring 9 and then through the longitudinal guide opening 14 of the mounting bolt 15. The mounting bolt 15 is inserted through a mounting opening 13 disposed on the ledge 4 and is fastened to the ledge by a mounting nut 16 having pins 17. The mounting bolt 15 and the mounting nut 16 together fasten hinge mount 6 of the toilet seat and lid assembly to the toilet ledge 4. The mounting bolt 15 may be constructed of plastic or non-corrosive metal, and other like materials. The mounting nut 16 is preferably constructed of plastic, as are most conventional toilet seat and lid assembly mounting nuts.

Figure 6A:
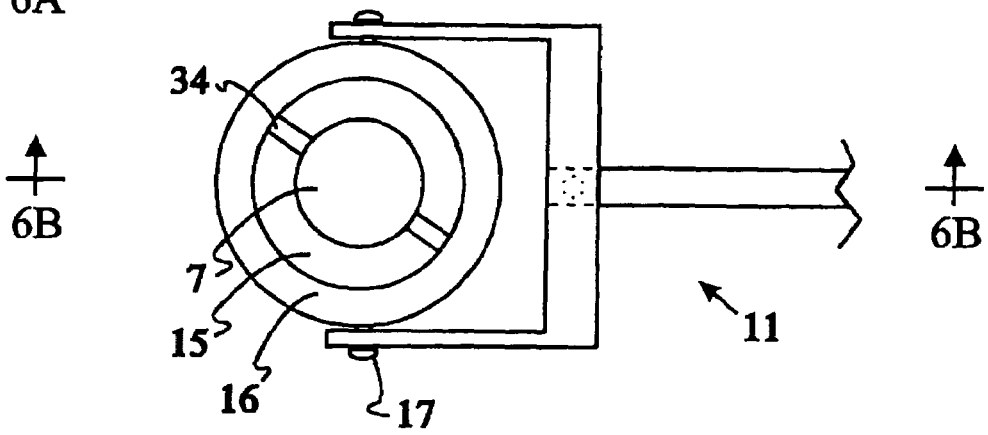
FIG. 6A is a top plan view of a portion of the first embodiment of the closure apparatus shown in FIGS. 3-5.
Figure 6B:
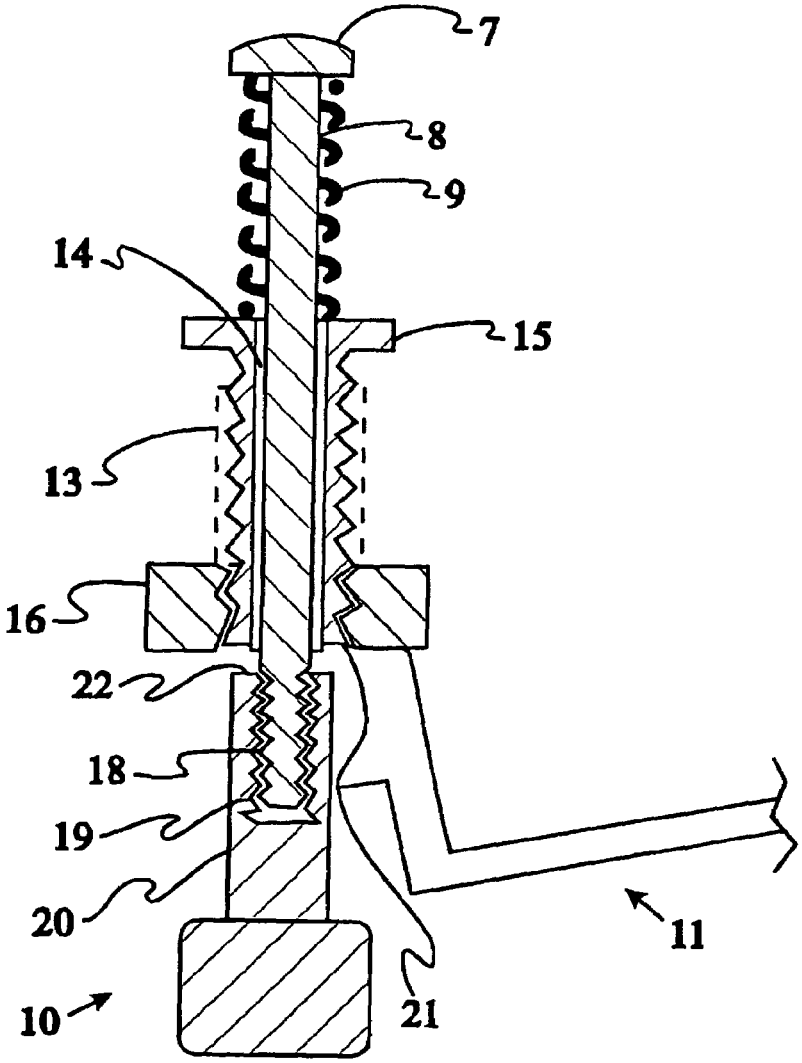
FIG. 6B is a cross-sectional view of a portion of the first embodiment of the closure apparatus taken along line 6B-6B of FIG. 6A.

FIGS. 6A and 6B illustrate the arrangement of the rod 8, the compression spring 9, the mounting bolt 15 with the longitudinal guide opening 14 inserted through opening 13 in ledge 4 (shown in FIGS. 3-5), the mounting nut 16 and a portion of a lever 11, which is discussed in more detail below. In addition, a slot 34 is provided on the top of mounting bolt 15 to permit said bolt to be screwed down into mounting nut 16.

The closure apparatus also includes an adjustment mechanism, such as a stop adjuster 10. As shown in FIG. 6B, the stop adjuster 10 includes a top portion having female threads 19 for engaging the male threads 18 disposed on the second end of the rod 8. The stop adjuster 10 also includes a smooth side surface area 20 and a top surface 22. The stop adjuster 10 is of larger diameter than rod 8 and may be constructed of plastic or a non-corrosive metal, and other like materials.

Figure 7:
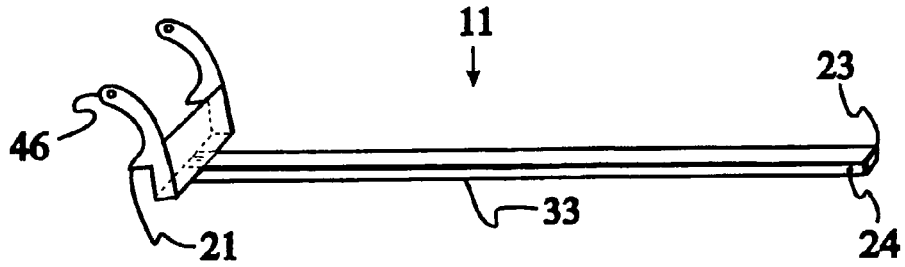
FIG. 7 is a perspective view of a lever used in the first, second and third embodiments of the closure apparatus.

The closure apparatus further includes a lever 11, as shown in FIGS. 3-5, and most specifically, in FIG. 7. The lever 11 includes a front end 46 having at least one opening for receiving a pin 17 of the mounting nut 16 and a latch point 21 for engaging the adjustment mechanism. More specifically, the latch point 21 engages the top surface 22 of the stop adjuster 10. The lever 11 also includes a rearward extension 33 and rearward end 23 having an opening 24. It is mounted on the pins 17 of the mounting nut 16 and pivots about the pins 17. The lever 11 is preferably constructed of non-corrosive metal, and may be constructed of other like materials.

In FIG. 3, the lever 11 is shown with its rearward end slightly elevated because the side surface area 20 of the stop adjuster 10 is preventing latch point 21 of latch lever 11 from moving inward toward the rod 8. This condition exists when the lid 5 is in the closed position and the rod 8 is in an extended or elevated position.

When rod 8 and stop adjuster 10 are sufficiently depressed, the latch point 21 of latch lever 11 typically engages the top surface 22 of the stop adjuster 10. When the rod 8 and stop adjuster 10 are not sufficiently depressed, the latch point 21 of the latch lever 11 may slide on the side surface 20 of stop adjuster 10. The threaded engagement of stop adjuster 10 with rod 8 allows the stop adjuster 10 to be adjusted at the point where latching will occur to accommodate different thickness of ledge 4 on which the closure apparatus may be mounted.

The closure apparatus further includes a latch release mechanism. The latch release mechanism may include an actuating member, such as a cable 25 or nylon line, having a first end 25*a* and a second end 25*b*. The first end 25*a* is attached to the lever 11 and the second end 25*b* is linked to a flush mechanism, or a device that is actuated in response to flushing the toilet, such as a flush arm 30 or a float arm, disposed within tank 2 of the toilet 1. More specifically, the first end 25*a* of the cable 25 is attached to the rearward end 23 of the lever 11 through the opening 24 of the lever 11. The actuating member may also comprise any electric or electromechanical device.

Figure 8A:
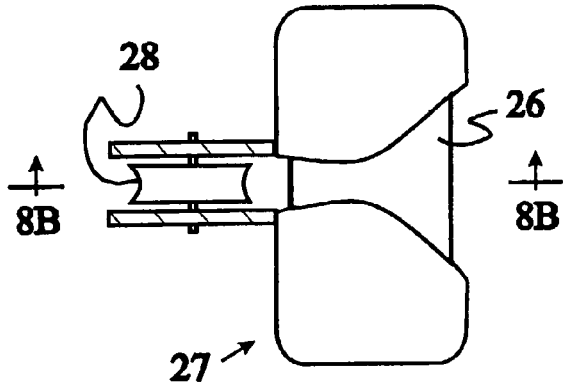
FIG. 8A is a top plan view of a bracket used in the first, second and third embodiments of the closure apparatus.
Figure 8B:
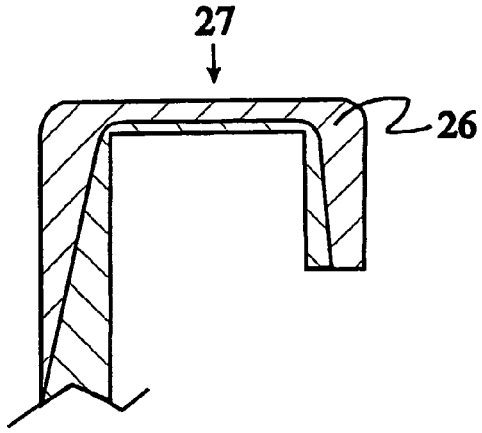
FIG. 8B is a cross-sectional view of the bracket taken along line 8B-8B of FIG. 8A.

The latch release mechanism may further include a bracket 27 for receiving the cable 25 that is adapted to be mounted on a rear wall of the tank 2 and includes a groove 26. As illustrated in FIG. 8A, a pulley 28 is mounted to the bracket 27 at a lower end, and the groove 26 is included in a top portion of bracket 27. FIG. 8B shows the top portion of the bracket 27. More specifically, the cable 25 proceeds through opening 24 of latch lever 11 upward behind the toilet's tank 2 and through the groove 26 provided in the bracket 27. The bracket 27, which is preferably constructed of plastic, preserves a small gap between the cable 25, and the underside and flanges of a tank top when fitted on tank 2. This assures free movement back and forth of the cable 25 through the groove 26. The cable 25 then proceeds from the groove 26 downward under the pulley 28 provided at the lower end of the bracket 27 and then upward where it attaches to an adjusting chain 29, similar to those commonly used to attach flush valve flaps to flush arms. The adjusting chain 29 in turn attaches to the toilet's flush arm 30 by a fastener, such as a S-hook 31.

Alternatively, the latch release mechanism may include a solenoid mounted at a bottom rear of the toilet tank 2 and connected to the rearward end 23 of the lever 11. The solenoid may be activated, for example, by a switch mechanism disposed on the flush arm 30 or float arm instead of cable 25.

FIG. 4 shows lid 5 raised to its full upright position, pivoting about its pivot point 12. Its rearward edge 32 has engaged and depressed rod 8 which has stressed compression spring 9 and moved side surface area 20 of stop adjuster 10 below latch point 21 of latch lever 11. As shown, when this occurs the weight of rearward extension 33 of latch lever 11, relative to its pivot point at pins 17, rotates latch lever 11 clockwise. This results in the engagement of latch point 21 with the top surface 22 of stop adjuster 10, and the latching of the rod 8 in its depressed position with its associated compression spring 9 deformed. In this state the interface of latch point 21 with top surface 22 of stop adjuster 10, and the pivot point of the lever 11 at pins 17 are both approximately vertically aligned with rod 8, permitting the interface to be small, yet still securely latch rod 8 with the energy stored in deformed spring 9.

FIG. 5 illustrates the toilet being flushed, with the flush handle 3 depressed and the flush arm 30 raised. By pulling the adjusting chain 29 and the adjusting side of the cable 25 upward, the cable 25 on the opposite side of the pulley 28 moves downward and the cable 25 behind tank 2 moves upward, thereby generating a pulling force that is applied to lever 11. More specifically, the force is applied at the opening 24 near the rear end of 23 of latch lever 11 where the cable 25 is attached. Because the previously described interface of latch point 21 and top surface 22 (shown in FIG. 4) of stop adjuster 10 is small, the interface presents only a small amount of friction to overcome to release the latch condition. In addition, because the rearward extension 33 of latch lever 11 relative to its pivot point at pins 17 provides substantial leverage, only a few ounces (less than 100 grams) of pulling force need be applied by cable 25 at its attachment point to opening 24 of latch lever 11 to release the latch point 21. Accordingly, just a slight pull by the cable 25 at the opening 24 of the latch lever 11 results in an upward movement of the rearward end 23 of latch lever 11, causing latch lever 11 to pivot counter-clockwise about pins 17 and disengaging latch point 21 from the top surface 22 (shown in FIG. 4) of stop adjuster 10.

When disengaged, deformed compression spring 9 forces the rod 8 upward. The top portion 7 of rod 8 then pushes the rearward edge 32 of lid 5, resulting in the lid 5 being tilted forward about its pivot point 12 to a point at which lid 5 will continue to close of its own weight and momentum to a fully-closed position. In some toilet configurations the cover may softly close instead of sometimes forcefully and loudly closing due to its own weight and momentum. In any case, when a user wishes to flush a toilet while sitting on the seat, although the closure apparatus does initiate closure of the cover, there is insufficient force to discomfort a user seated on the toilet. By simply leaning gently backward, the user may re-latch the cover or lid 5 into an open position. In addition, the closure apparatus does not interfere with manual closing of the cover or lid 5 before flushing, if desired.

Referring again now to FIG. 3, when the flush handle 3 is released, the pull of flush arm 30 on the adjusting chain 29 and cable 25 is released and the weight of rearward extension 33 of latch lever 11 is free to pull the cable 25 downward. This allows for immediate resetting of the lever 11 when the lid is next raised. This is advantageous in several circumstances, for example, when another user wishes to use the toilet immediately after a first user and before the toilet's tank has filled entirely with water as well as when a user wishes to flush a toilet while seated on the toilet seat.

Figure 10A:
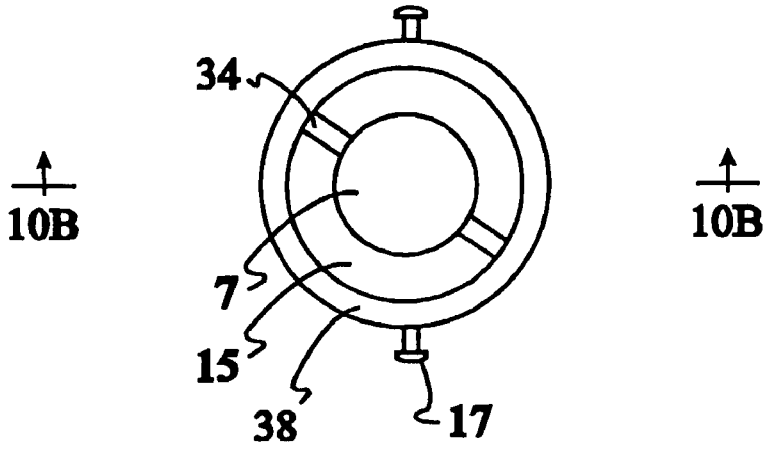
FIG. 10A illustrates a portion of a second embodiment of the closure apparatus.
Figure 10B:
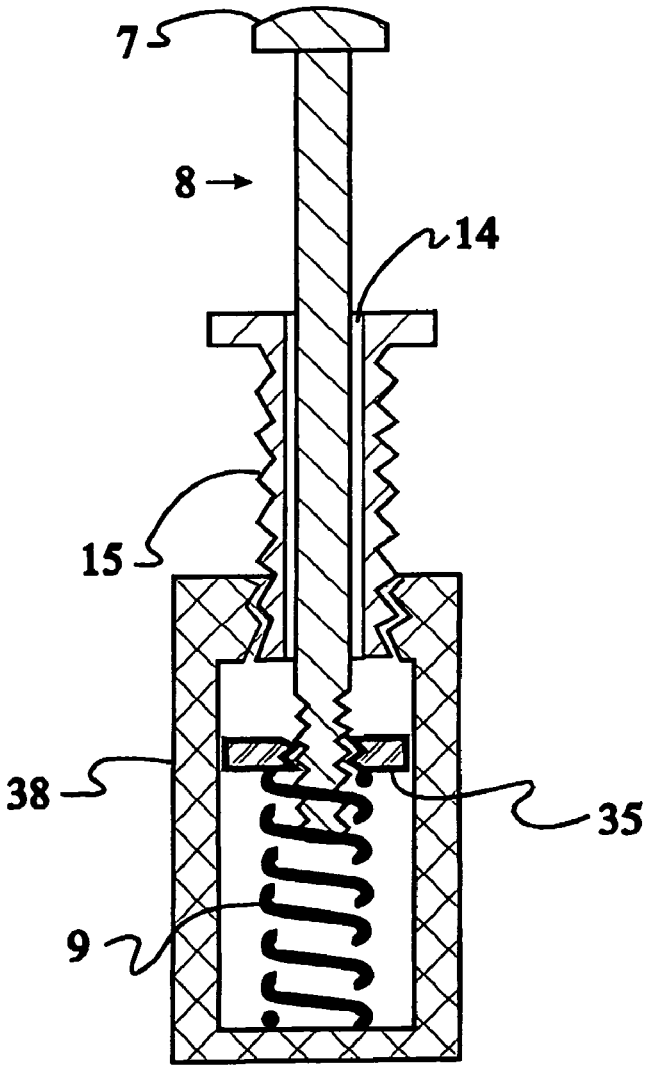
FIG. 10B is a cross-sectional view of the second embodiment of the closure apparatus taken along line 10B-10B of FIG. 10A.
Figure 11:
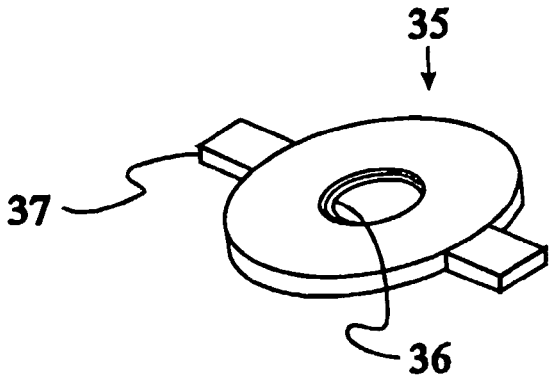
FIG. 11 is a perspective view of a washer used in the second embodiment of the closure apparatus.
Figure 12:
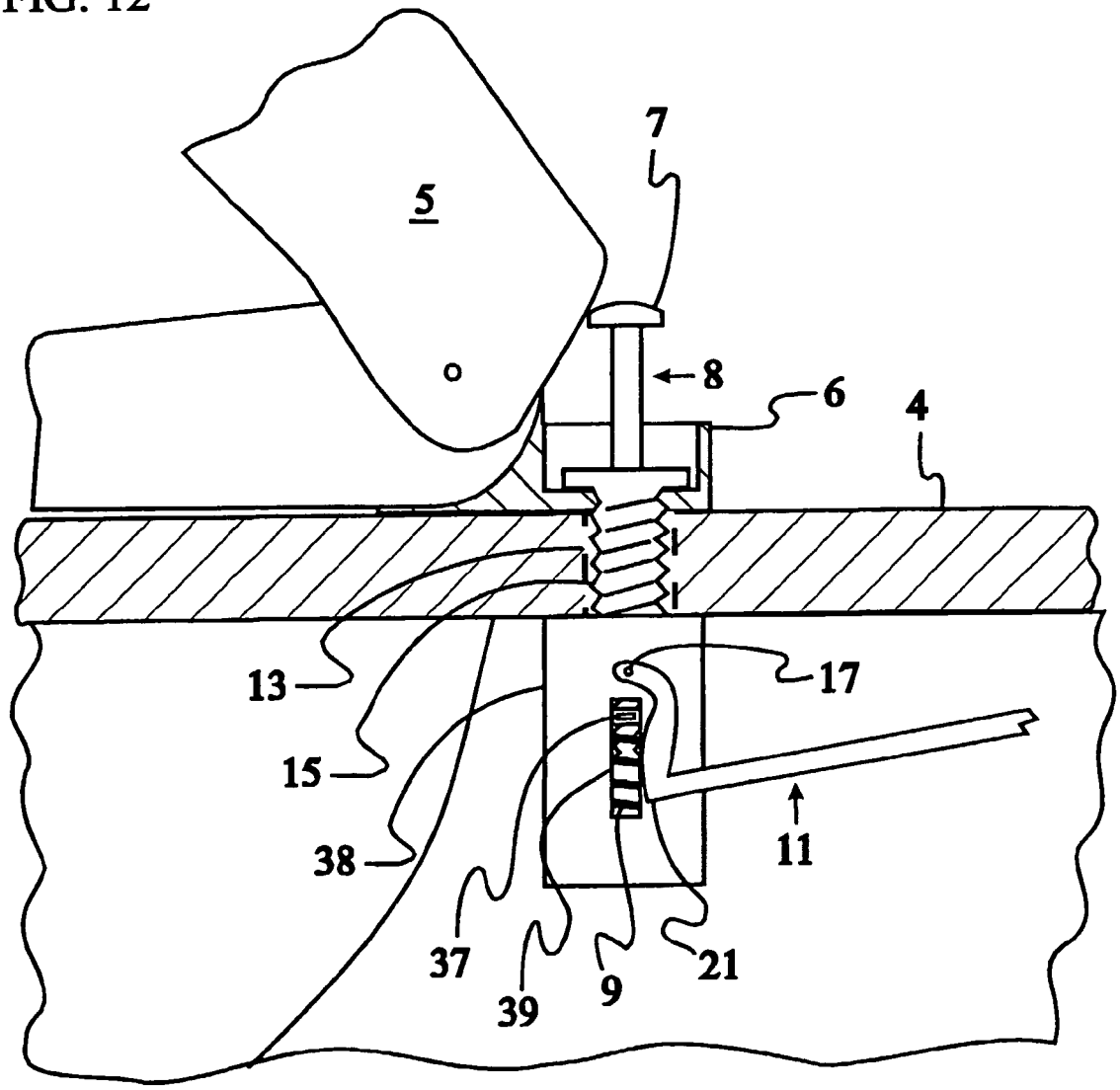
FIG. 12 is a side elevational view of the second embodiment of the closure apparatus, wherein the toilet ledge is shown in section.

Referring now to FIGS. 10-12, a second embodiment of the closure apparatus is shown. Like the first embodiment of the closure apparatus, the closure apparatus shown in FIGS. 10 and 12 includes a rod 8 having a first end disposed above the ledge 4 and a second end disposed below the ledge 4. The rod 8 also includes a head 7 disposed at its first end and a series of male threads at its second end. A mounting bolt 15 is also included which has an opening, such as a longitudinal guide opening 14, for receiving the rod 8.

This closure apparatus, however, differs from the first embodiment of the closure apparatus. For example, this second embodiment of the closure apparatus does not include a compression spring disposed around the rod 8 above the ledge 4 like the first embodiment. Rather, as shown in FIGS. 10A, 10B and 12, a spring holder 38 is disposed below the ledge 4 and a compression spring 9 is disposed therein. The spring holder 38 further includes a threaded top portion for engaging the bolt 15. The top portion of the spring holder 38 function in a manner similar to a mounting nut. The spring holder 38 is preferably constructed of plastic.

In addition, as shown in FIG. 11, the adjustment mechanism of the second embodiment of the closure apparatus is a washer, or stop member, 35. The washer 35 is disposed within the spring holder 38 and may engage the latch point 21 of the lever 11. The washer 35 includes a female threaded center opening 36 suitable for threading onto the lower end of rod 8 and ears 37, and is preferably constructed of non-corrosive metal. As shown in FIG. 10B, the washer 35 provides a spring-abutting surface such that the spring 9 is interconnected to a portion of the spring holder 38 and to the washer 35.

As shown in FIG. 12, the spring holder 38 further includes side openings 39 through which the ears 37 of washer 35 extend, thereby allowing the latch point 21 of lever 11 to engage the ears 37 and prevent rotational movement of the washer 35 when rod 8 is threaded into it. Rod 8 is adjustably threaded into the washer 35, which sits on compression spring 9 within the spring holder 38.

As illustrated in FIG. 10A, enlarged head 7 of rod 8 (shown in FIG. 10B) sits above the mounting bolt 15 having a slot 34 and the top portion of the spring holder 38 is provided with pins 17 for mounting the lever 11 (shown in FIGS. 3-6).

Figure 13:
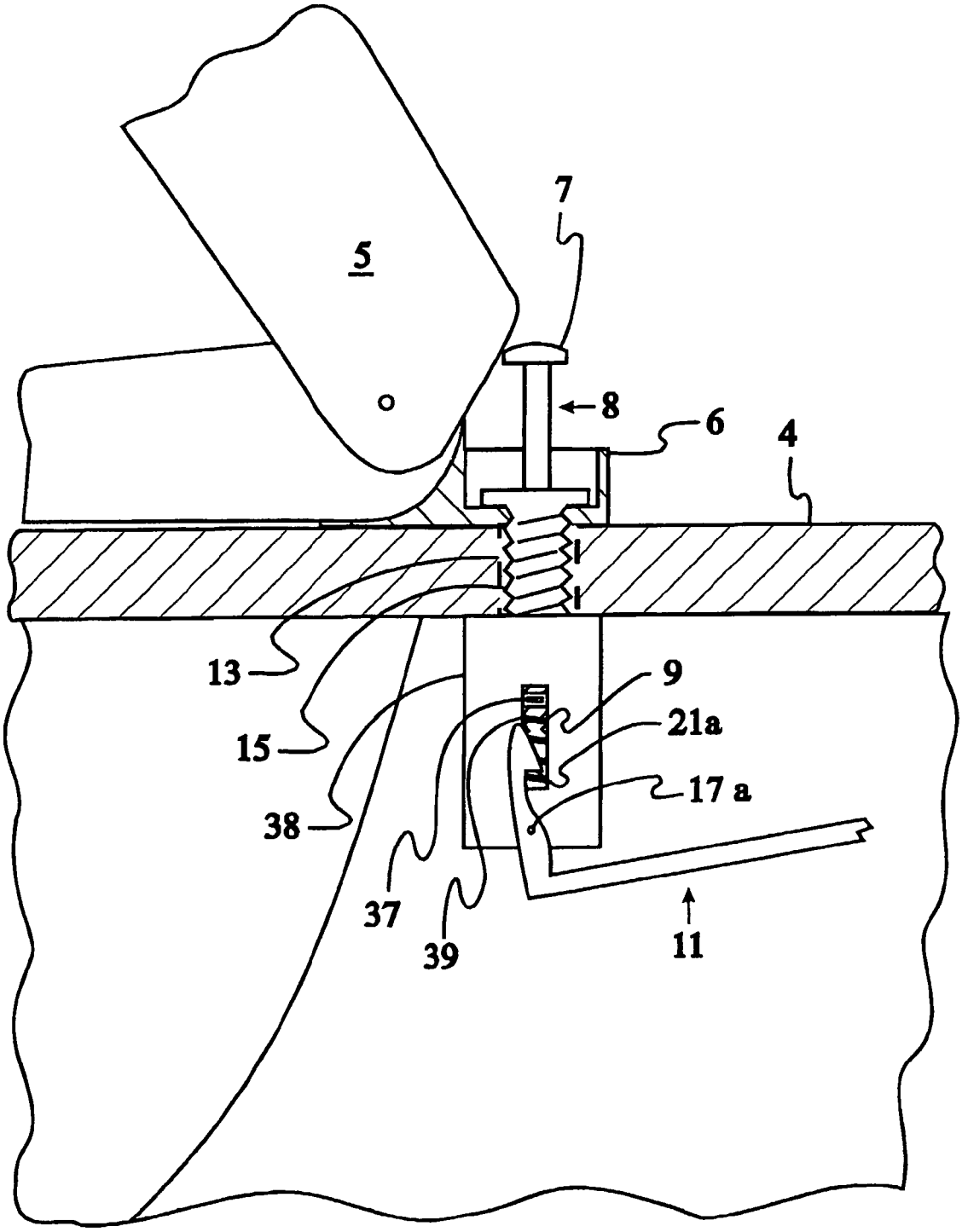
FIG. 13 is a side elevational view of the second embodiment of the closure apparatus, wherein the toilet ledge is shown in section and a lever is disposed at a bottom portion of a spring holder.

Alternatively, as illustrated in FIG. 13, the lever 11 may be mounted to a bottom portion of the spring holder 38. More specifically, the lever 11 may have a pivot point at 17*a* which may be connected to the spring holder 38 below the spring. Here the lever 11 may also have a latch point 21*a* for engaging the ears 37.

The latching and unlatching operation of this closure apparatus is essentially the same as that of the previously described first embodiment of the closure apparatus, except that compression spring 9 is compressed by washer 35 instead of the head 7 of rod 8. In addition, latch point 21 of latch lever 11 latches upon ears 37 of washer 35 instead of latching upon the top surface 22 of stop adjuster 10 (shown in FIGS. 3-6) to latch and unlatch rod 8. The threaded interface of rod 8 and washer 35 provides a mechanism for adjusting the height of rod 8 at which latching will occur to accommodate different thicknesses of ledge 4 on which this embodiment of the closure apparatus may be mounted.

Figure 14:
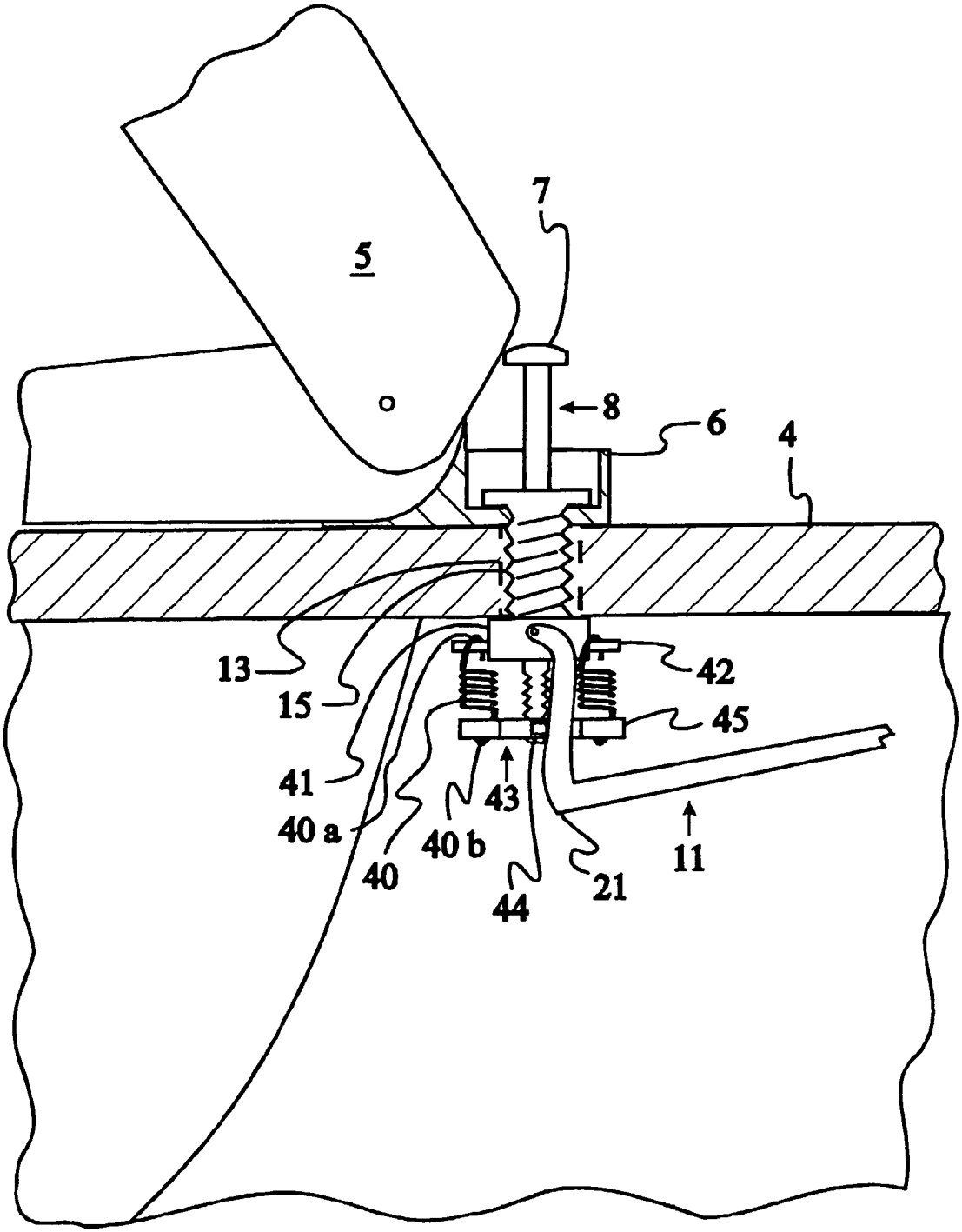
FIG. 14 is a side elevational view of a third embodiment of the closure apparatus, wherein the toilet ledge is shown in section.

Referring now to FIG. 14, a third embodiment of the closure apparatus is provided. Like the first and second embodiments of the closure apparatus, and as shown in FIG. 14, the third embodiment of the closure apparatus includes a rod 8 having a first end disposed above the ledge 4 and a second end disposed below the ledge 4. The rod 8 also includes a head 7 disposed at its first end and a series of male threads at its second end. A mounting bolt 15 is also included which has an opening, such as a longitudinal guide opening 14, for receiving the rod 8.

The third embodiment of the closure apparatus, however, differs from the first and second embodiments of the closure apparatus. For example, the third embodiment of the closure apparatus includes a set of expansion springs 40 that are positioned below the ledge 4, instead of a compression spring 9 as used in the second embodiment of the closure apparatus. Each expansion spring 40 includes a first end 40*a* and a second end 40*b*.

In addition, the adjustment mechanism of this closure apparatus includes a washer 43 similar to washer 35 (shown in FIG. 11) of the second embodiment. The washer 43 has a threaded center opening suitable for threading onto rod 8 and ears 44 suitable to interface with latch point 21 of latch lever 11. The washer 43 also provides, at a 90 degree differential from the ears 44, arms 45 adapted to be attached to the second ends 40*b* of the expansion springs 40. The washer 43 is preferably constructed of non-corrosive metal, and the like.

In this embodiment, a mounting nut 41 is provided which, in addition to pins 17 upon which latch lever 11 may be mounted, provides arms 42 to which the first ends 40*a* of expansion springs 40 may be attached at a 90 degree differential from said pins 17.

The operation of this third embodiment of the closure apparatus is essentially the same as that of the second embodiment of the closure apparatus, except that the closure apparatus of this embodiment stresses its expansion springs 40 by expanding them, instead of by compression. This closure apparatus may be adjusted in the same manner as the closure apparatus of the second embodiment.

Each of the foregoing embodiments of the closure apparatus may be relatively simply installed. Mounting bolt 15, with rod 8 inserted in it, is installed and tightened in the same manner as a conventional toilet lid and seat mounting bolt except that it threads into one of the combination mounting nut and latch lever mounting apparatus described instead of into a standard mounting nut. For example, the mounting nut 16 may then be attached to the mounting bolt 15, such that the mounting nut fastens the mounting bolt to the bowl ledge 4. Rod 8 is then inserted through the longitudinal guide opening 14 of mounting bolt 15 and threaded into the adjustment mechanism, such as the stop adjuster 10 or washer 35 or 43 as described.

A spring is also provided, for example around the rod 8 or below the bowl ledge 4, depending on the preferred embodiment. More specifically, in the first embodiment of the closure apparatus a compression spring 9 is disposed around the rod 8. In the second embodiment of the closure apparatus, a compression spring 9 is disposed below the bowl ledge 4 and is disposed within the spring holder 38. In the third embodiment, at least one expansion spring 40 is positioned below the ledge 4 and each spring 40 is attached at one end to a mounting nut 41 and at a second end to a washer 43.

A lever 11 movable with respect to the mounting bolt is also provided. More specifically, the lever 11 may be attached to the mounting nuts 16 or 41 or a portion of the spring holder 38.

The first end of the actuating member, such as a cable 25, is then connected to the lever 11 and the second end of the actuating member is linked to the flush mechanism. More specifically, a toilet tank cover is first removed and the bracket 27 having a groove 26 is mounted to the toilet tank 2, for example, to a top portion of the toilet tank 2. The actuating member, for example the cable 25, is then pulled upward and around the back portion of the tank 2, and placed in the groove 26 of the bracket 27.

After the actuating member is placed in the groove 26, it is then attached to the flush mechanism. More specifically, the actuating member may be disposed around a pulley 28 disposed within the tank 2 and then attached to an adjusting chain 29. The adjusting chain 29 may then be connected to the toilet's existing flush arm 30, with any slack removed, and the top of the tank 2 may be replaced. Alternatively, the actuating member may be attached to a flush arm 30 or a float arm, or other device disposed within a toilet tank 2.

Figure 15:
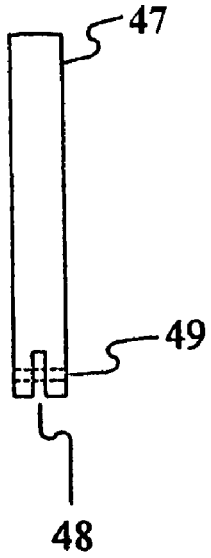
FIG. 15 is a side elevational view of the rod used in the preferred embodiment of the closure apparatus.
Figure 16:
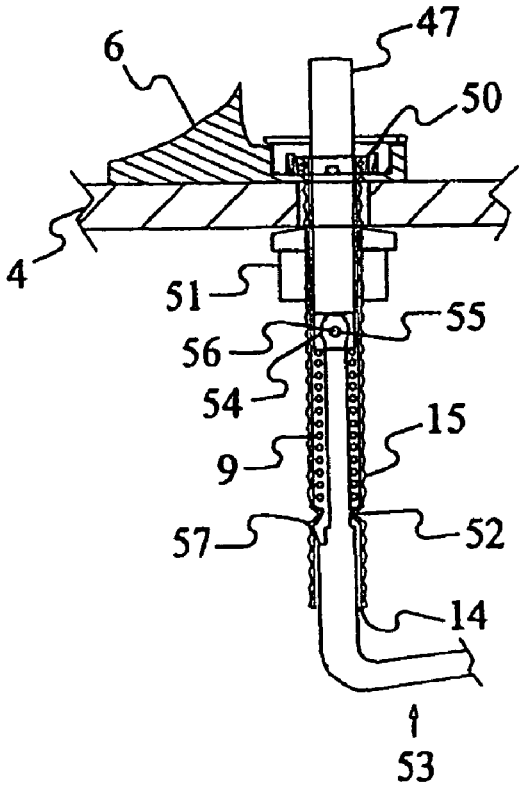
FIG. 16 is a cross-sectional view of a portion of the preferred embodiment of the closure apparatus, wherein the rod is in the extended position.
Figure 17:
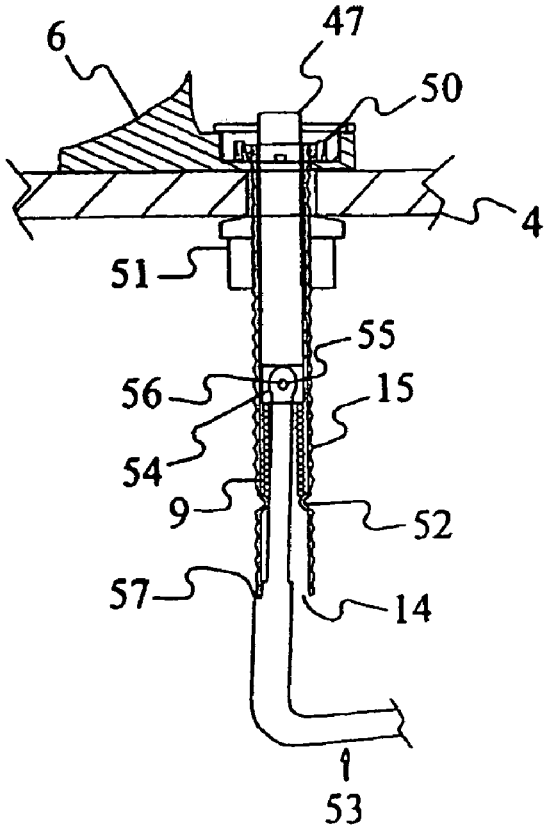
FIG. 17 is a cross-sectional view of a portion of the preferred embodiment of the closure apparatus, wherein the rod is in the depressed position.

Referring now to FIGS. 15-18, a preferred embodiment of the closure apparatus is provided. Like the foregoing embodiments of the closure apparatus, and as shown in FIGS. 16-17, the preferred embodiment of the closure apparatus includes a rod or shaft 47 having a first end disposed above the ledge 4 and a second end disposed within the longitudinal opening 14 in the mounting bolt 15. The rod 47 is supported for longitudinal sliding movement relative to the bolt 15 and relative to the bowl ledge 4.

The preferred embodiment of the closure apparatus, however, differs from the foregoing embodiments of the closure apparatus. For example, as shown in FIG. 15, the rod 47 lacks the head 7 disposed at the first end of the rod 8, as used in the foregoing embodiments, and at its second end, rod 47 of the preferred embodiment is provided with a slot 48 and, at a 90 degree differential, an opening 49, instead of the series of male threads 18 as used in the foregoing embodiments.

In addition, as shown in FIGS. 16 and 17, a compression spring 9 adapted to be inserted into the longitudinal opening 14 of the mounting bolt 15 is provided.

In addition, it may be seen that the mounting bolt 15 of the preferred embodiment of the closure apparatus lacks a bolt head at its top end, as provided in the prior embodiments. Instead, a cap nut 50 having female threads and adapted to be threaded onto the top end of the mounting bolt 15 is provided. In addition, the mounting bolt 15 of the preferred embodiment is provided with, for example, one or more indentations 52 which constrict the inside diameter of the longitudinal opening 14 of the mounting bolt 15 at a desired point, such that they may provide a seat upon which the bottom end of the compression spring 9 may rest when the compression spring 9 is inserted in the longitudinal opening 14 of the mounting bolt 15.

In addition, the preferred embodiment provides a mounting nut 51 similar to a conventional toilet lid and seat assembly mounting nut.

The preferred embodiment of the closure apparatus also includes a lever or latch 53 having an opening 55 disposed at the top of its front end 54, which is adapted to be insertable through the spring 9 and into the slot 48 provided at the second end of the rod 47 and pivotally attached to rod 47 by a pin 56 provided. The pin 56 is adapted to be inserted through the opening 49 of the rod 47 and the opening 55 of the lever 53. The lever 53 also includes a latch point 57.

Figure 18:
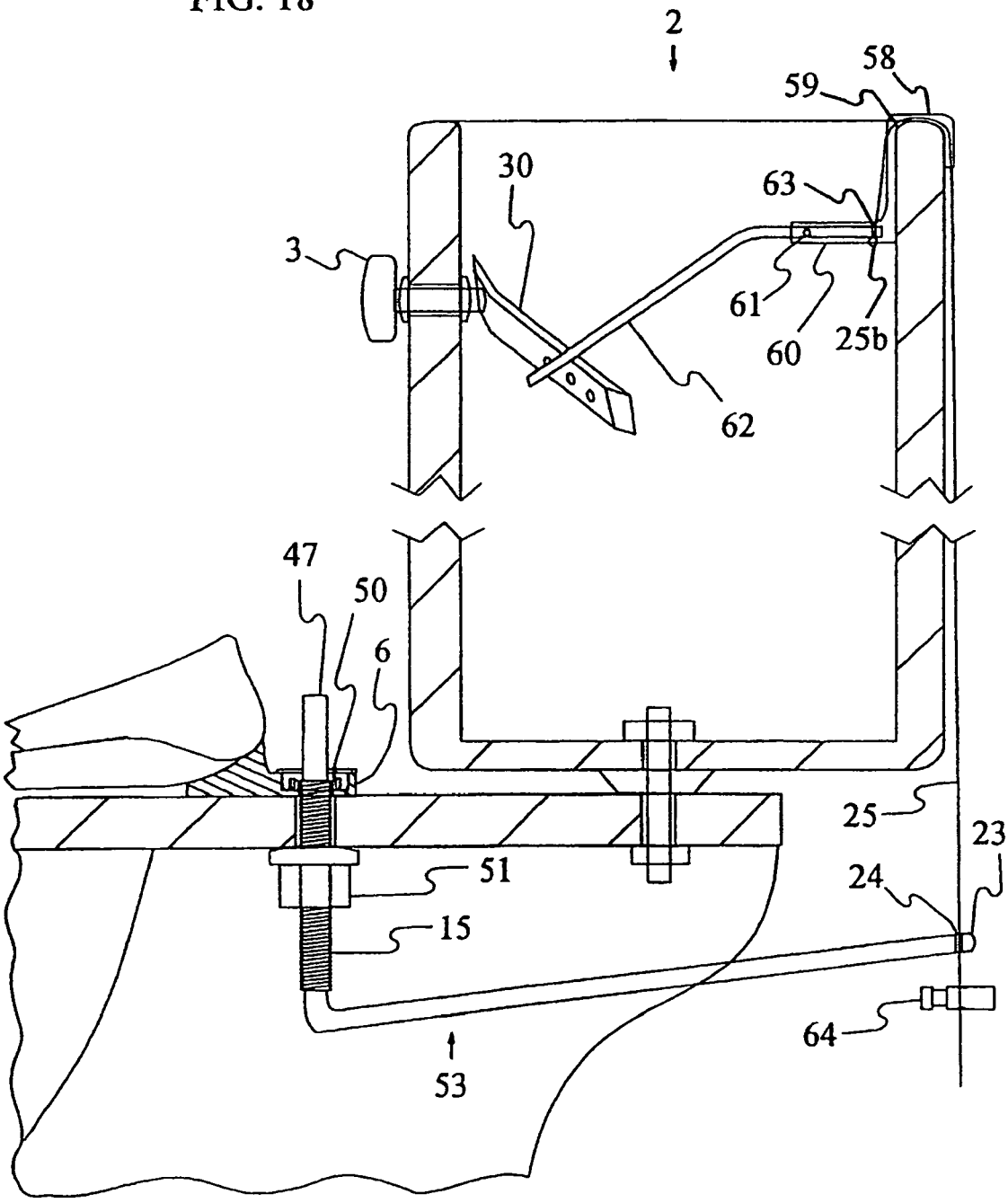
FIG. 18 is a side elevational view of the preferred embodiment of the closure apparatus, wherein the tank, bowl ledge and hinge mount are shown in section and the rod is in the extended position.

Referring now to FIG. 18, it may be seen that lever 53, like lever 11 of the prior embodiments, extends rearwardly and is provided at its rearward end 23 with an opening 24.

In addition, the preferred embodiment also includes a bracket 58 having a groove 59 at its top end and a forward extension 60 with at least one opening 61 therein at its lower end, instead of the pulley 28 as used in the foregoing embodiments.

In addition, the preferred embodiment of the closure apparatus also includes a lever 62 adapted to be pivotally mounted to the at least one opening 61 in the forward extension 60 of the bracket 58 and extend forwardly from its pivot point over the flush arm 30 of the toilet and rearwardly to just inside the rear wall of the tank 2. The lever 62 is provided near its rearward end with an opening 63.

This embodiment is further provided with a cord lock 64, for example of one of the types commonly used on clothing having drawstrings.

As shown in FIG. 18, an actuating means, such as cable 25, is attached at its second end 25*b* to the opening 63 in the lever 62, proceeds through groove 59 in bracket 58 and downward through opening 24 near the rearward end of lever 53 and then through cord lock 64. Cord lock 64 may then be squeezed and moved to adjust the length of the actuating means, such as cable 25, to accommodate toilets with tanks of different heights and hinge mounts of different thicknesses. By being attached to the lever 62, the cable 25 is coupled to a moving part (e.g., the flush arm 30) of the flush mechanism.

The latching operation of this preferred embodiment of the closure apparatus is similar to that of the foregoing embodiments of the closure apparatus, except that, as shown in FIGS. 16 and 17, the compression spring 9 of this embodiment is compressed by the second end of the rod 47, instead of by the head 7 of the rod 8 or by washers 35 or 43 as used in the first, second and third embodiments, respectively. In addition, and as shown in FIG. 17, because of its previously described pivotal attachment to rod 47, lever 53 of this preferred embodiment moves downward as rod 47 is depressed and, once latch point 57 of lever 53 is below the bottom end of the mounting bolt 15, the lever 53 may rotate clockwise such that the latch point 57 of the lever 53 latches upon the bottom edge of the mounting bolt 15. This provides a means for releasably holding the rod or shaft 47 in the retracted position against the biasing force of the spring 9.

The latch releasing operation of this preferred embodiment of the closure apparatus is also similar to that of the foregoing embodiments of the closure apparatus, except that, when the toilet is flushed and the flush arm 30 is raised, the flush arm 30 raises the forward extension of the lever 62 upward, which moves the rearward extension of lever 62 downward and the cable 25 behind the tank and cord lock 64 attached thereto upward. When the cord lock contacts the rear end 23 of lever 53, it raises the rear end 23 of the lever 53 causing the lever to rotate counter-clockwise, releasing the latch condition between the latch point 57 of the lever 53 and the bottom end of the mounting bolt 15. This provides a means responsive to movement of the flush mechanism, such means actuating the means for releasably holding the rod 47 in response to flushing.

This preferred embodiment of the closure apparatus may be provided fully assembled except for the cap nut 50 in order to make it easy to install. It may be installed by inserting the mounting bolt 15 upward through the bottom of the mounting opening 13 in the bowl ledge 4 and through the hinge mount 6 of a toilet seat and lid assembly, threading the cap nut 50 onto the top of the mounting bolt 15 and then tightening the mounting nut 51 under the bowl ledge 4 by hand. After removing the top from the tank 2, the bracket 58 may be mounted atop the rear wall of the tank 2 with the forward extension of the lever 62 resting atop the flush arm 30 and the top of the tank 2 may be replaced. With the lid 5 lifted (as shown in FIG. 4) to latch the closure apparatus in the latched position, which corresponds to the lowest position of the rear end 23 of the lever 53, the cord lock may be squeezed and moved to just below the opening 24 near the rear end 23 of lever 53.

From the foregoing, it may be seen that a relatively simple and inexpensive mechanical closure apparatus has been provided that automatically closes a toilet cover upon flushing a toilet, for example, in a conventional manner using a flush handle. The closure apparatus may be easily installed without the need for tools. It may be used by anyone capable of raising the lid and flushing the toilet using the flush handle.

From the foregoing, it may also be seen that a relatively unobtrusive closure apparatus has been provided. In order to be minimally obtrusive as to user interaction, the rod 8 or 47, for example, is placed through the hinge mount opening only about one inch (2.54 centimeters) behind the cover, such as lid 5, and the seat pivot axis 12 as opposed to a point ten to 14 inches (25.4 to 35.6 centimeters) in front of the axis at which a user would ordinarily grasp a cover, such as a lid 5, a seat, or a lid and seat assembly. This configuration provides such substantial mechanical advantage to the user that the additional force required of a user to depress the rod 8 or 47 and stress the associated spring or springs, as well as lift the cover is minimal. Additionally, the latch mechanism is so constructed that minimal force is required to release the latch point 21, 21*a*, or 57. The latch lever 11 or 53 is positioned directly below the ledge's mounting opening, pivots at a point above or below its latch point 21 or 57 and extends rearward about 9 inches (22.9 centimeters) toward the rear of the toilet's tank 2. At the rear of the toilet's tank 2 it attaches to the latch releasing mechanism.

This configuration enables utilization of a small latch interface with minimal friction, eliminates the need for a latch-biasing spring whose resistance must be overcome to release the latch point 21 or 57, provides a substantial mechanical advantage to the latch releasing mechanism, and eases the path of the latch releasing mechanism by avoiding obstacles such as toilet tank mounting bolts and a sharply-angled pull around the rear bottom corner of the tank. Accordingly, the latch release mechanism requires a minimal force, such as only a few ounces (less than 100 grams), to move the rearward end of the latch lever 11 or 53. Therefore, the latch releasing mechanism can be actuated, for example, by a direct mechanical connection to a flush mechanism, such as a toilet's existing float arm or flush arm 30, without over stressing the flush mechanism and with only minimal added force being required to be applied to the flush handle 3 by the user.

Utilizing the flush mechanism, such as the flush arm 30, in this manner allows the latch lever 11 or 53 to be reset immediately upon release of the flush handle 3 by a user, which is advantageous, for example, when another user wishes to use a toilet 1 immediately after a prior user and before the toilet's tank 2 has refilled with water.

While the closure apparatus has been described with reference to specific examples, which are intended to be illustrative only and not limiting, it will be apparent to those of ordinary skill in the art that changes, additions or deletions may be made to the disclosed embodiments without departing from the spirit and scope of the invention. For example, rod 8 or 47 could be a rigid tubular structure instead of a solid rod structure and either form could be a square or rectangular in shape rather round, provided longitudinal guide opening 14 in mounting bolt 15 was compatibly configured to guide such alternative constructions of rod 8 or 47. In addition, cable 25 could also be a line, cord or strap and, the latch release mechanism could be actuated by connection of cable 25 to the toilet's float arm or an added float/weight instead of to the toilet's flush arm, without departing from the spirit of the present invention.

I claim:

1. A closure apparatus adapted to mount to a toilet, the toilet having a cover and a bowl ledge, the closure apparatus comprising:

a mounting bolt having an opening extending therethrough;

a rod disposed within the opening of the mounting bolt;

a spring adapted to be deformed by the rod to thereby bias the rod;

a lever movable with respect to the mounting bolt, the lever including a latch point; and a latch release mechanism coupled to the lever;

wherein when the closure apparatus is mounted to the bowl ledge, upon flushing the toilet when the cover is open, the latch release mechanism is actuated in response to flushing of the toilet to cause the latch point of the lever to move with respect to the mounting bolt allowing the spring to move the rod which pushes the cover, to thereby close the cover; and wherein the latch release mechanism includes an actuating member having a first end attached to the lever and a second end coupled to a flush arm, such that, upon flushing the toilet when the cover is open, the flush arm moves the actuating member to cause the latch point of the lever to move with respect to the mounting bolt allowing the spring to move the rod which pushes the cover, to thereby close the cover.

2. A closure apparatus adapted to mount to a toilet, the toilet having a cover and a bowl ledge, the closure apparatus comprising:

a mounting bolt having an opening extending therethrough;

a mounting nut configured to be threaded onto the mounting bolt for fastening the mounting bolt to the bowl ledge;

a rod disposed within the opening of the mounting bolt;

a spring adapted to be deformed by the rod to thereby bias the rod;

a lever movable with respect to the mounting bolt, the lever including a latch point; and a latch release mechanism coupled to the lever;

wherein when the closure apparatus is mounted to the bowl ledge, upon flushing the toilet when the cover is open, the latch release mechanism is actuated in response to flushing of the toilet to cause the latch point of the lever to move with respect to the mounting bolt allowing the spring to move the rod which pushes the cover, to thereby close the cover.

3. The closure apparatus of claim 2, further comprising a stop adjuster adjustably mounted to the rod, wherein the latch point engages a surface of the stop adjuster when the cover is open, and wherein the stop adjuster is adjustable with respect to the rod to alter where the latch point of the lever engages the stop adjuster.

4. The closure apparatus of claim 2, wherein the rod is actuable between a retracted position and an extended position, the rod pushing the cover closed when moving into the extended position, and wherein the spring biases the rod toward the extended position.

5. A closure apparatus adapted to close a cover hinged to a bowl ledge of a toilet, the closure apparatus comprising:

a shaft adapted for sliding movement with respect to the bowl ledge and movable between a retracted position and an extended position, the shaft being adapted to close the cover upon movement from the retracted position to the extended position, the shaft being biased toward the extended position; and a latch selectively movable between an engaged position in which the latch retains the shaft in the retracted position, and a released position in which the latch permits the shaft to be biased toward the extended position;

wherein the latch is adapted to move to the released position in response to flushing the toilet to permit the shaft to move toward the extended position to push the cover closed;

a mounting bolt adapted to be positioned within an aperture in the ledge, the mounting bolt having a longitudinally-extending hole therethrough;

a mounting nut configured to be threaded onto the mounting bolt for fastening the bolt to the bowl ledge, the nut and bolt together fastening a hinge mount of the cover to the ledge when the closure apparatus is mounted on the toilet;

wherein the shaft is slidable in the hole in the mounting bolt; and a cap nut threaded onto an end of the mounting bolt above the ledge, the cap nut covering the end of the mounting bolt and defining a hole through which the shaft extends, wherein the mounting nut is hand-tightenable to tighten the mounting nut against the bottom of the ledge and to tighten the cap nut against the top of the ledge.

6. A closure apparatus adapted to close a cover hinged to a bowl ledge of a toilet, the closure apparatus comprising:

a shaft adapted for longitudinal sliding movement with respect to the bowl ledge and movable between a retracted position and an extended position, the shaft being adapted to close the cover upon movement from the retracted position to the extended position, the shaft being biased toward the extended position;

a latch selectively movable between an engaged position in which the latch retains the shaft in the retracted position, and a released position in which the latch permits the shaft to be biased toward the extended position;

wherein the latch is adapted to move to the released position in response to flushing the toilet to permit the shaft to move toward the extended position to push the cover closed;

a mounting bolt adapted to be positioned within an aperture in the ledge, the mounting bolt having a longitudinally-extending hole therethrough; and a mounting nut configured to be threaded onto the mounting bolt for fastening the bolt to the bowl ledge, the nut and bolt together fastening a hinge mount of the cover to the ledge when the closure apparatus is mounted on the toilet;

wherein the shaft is slidable in the hole in the mounting bolt; and wherein the shaft is biased toward the extended position by a spring within the hole in the mounting bolt, wherein the hole in the mounting bolt includes at least one indentation defining a seat that retains the spring in the hole, wherein the latch includes a portion pivotally mounted to the shaft and a latch point engageable with an end of the mounting bolt, and wherein, upon movement of the shaft to the retracted position and pivoting of the latch portion with respect to the shaft, the latch point engages the end of the mounting bolt to retain the shaft in the retracted position.

7. A toilet comprising:

a toilet bowl having a ledge;

a cover coupled to the ledge and pivotable between an open position and a closed position; and a closure apparatus comprising a mounting bolt having an opening extending therethrough;

a rod disposed within the opening of the mounting bolt;

a spring adapted to be deformed by the rod to thereby bias the rod;

a lever movable with respect to the mounting bolt, the lever including a latch point; and a latch release mechanism coupled to the lever;

the closure apparatus being mounted to the bowl ledge such that, upon flushing the toilet when the cover is open, the latch release mechanism is actuated in response to flushing of the toilet to cause the latch point of the lever to move with respect to the mounting bolt allowing the spring to move the rod which pushes the cover, to thereby close the cover.

8. The toilet of claim 7, wherein the latch release mechanism includes an actuating member having a first end attached to the lever and a second end coupled to a flush arm, such that, upon flushing the toilet when the cover is open, the flush arm moves the actuating member to cause the latch point of the lever to move with respect to the mounting bolt allowing the spring to move the rod which pushes the cover, to thereby close the cover.

9. The toilet of claim 7, wherein the rod is actuable between a retracted position and an extended position, the rod pushing the cover closed when moving into the extended position, and wherein the spring biases the rod toward the extended position.

10. A toilet comprising:

a bowl ledge;

a cover mounted to the bowl ledge with a hinge mount;

a shaft adapted for longitudinal sliding movement with respect to the bowl ledge and movable between a retracted position and an extended position, the shaft being adapted to close the cover upon movement from the retracted position to the extended position, the shaft being biased toward the extended position;

a latch selectively movable between an engaged position in which the latch retains the shaft in the retracted position, and a released position in which the latch permits the shaft to be biased toward the extended position;

wherein the latch is adapted to move to the released position in response to flushing the toilet to permit the shaft to move toward the extended position to push the cover closed;

a mounting bolt adapted to be positioned within an aperture in the ledge, the mounting bolt having a longitudinally-extending hole therethrough; and a mounting nut configured to be threaded onto the mounting bolt for fastening the bolt to the bowl ledge, the nut and bolt together fastening the hinge mount of the cover to the ledge when the closure apparatus is mounted on the toilet;

wherein the shaft is slidable in the hole in the mounting bolt.

11. The toilet of claim 10, wherein the toilet includes a flush mechanism, the closure apparatus further comprising an actuating member having a first end coupled to the latch and a second end configured to be coupled to a moving part of the flush mechanism, such that, upon flushing the toilet when the cover is open, movement of the moving part causes the actuating member to move the latch to the released position.

12. The toilet of claim 10, wherein the shaft is biased toward the extended position by a spring.

13. The toilet of claim 10, further comprising a spring, wherein the shaft includes a head, and wherein the spring is positioned around the shaft and is compressed between the head of the shaft and a portion of the mounting bolt such that movement of the bolt toward the retracted position deflects the spring and the spring pushes against the shaft head to bias the shaft toward the extended position.

14. The toilet of claim 10, wherein the mounting nut is a spring holder mounted to an end of the mounting bolt and further comprising a spring inside the spring holder, wherein the shaft extends into and is movable with respect to the spring holder, and wherein the spring is interconnected to a portion of the spring holder and to a spring-abutting surface that is movable with the shaft, such that the spring deflects in response to the shaft moving toward the retracted position and biases the shaft toward the extended position.

15. The toilet of claim 14, further comprising a washer having at least one ear, wherein the washer is mounted to the shaft and includes the spring-abutting surface, wherein the washer is positioned within the spring holder, wherein the spring holder includes at least one slot through which the at least one ear extends, and wherein the latch engages the at least one ear to maintain the shaft in the retracted position.

16. The toilet of claim 10, further comprising a stop member mounted to the shaft; and a spring interconnected between the stop member and the mounting nut to bias the shaft toward the extended position; wherein the latch engages the stop member when the latch is in the engaged position.

* * * * *